United States Patent [19]

Durand

[11] Patent Number: 4,736,846

[45] Date of Patent: Apr. 12, 1988

[54] DISPLAY PACKAGING FOR A PLURALITY OF ALIGNED DRINKING GLASSES OR SIMILAR ARTICLES

[75] Inventor: Jean-Jacques Durand, Arques, France

[73] Assignee: Verrerie Cristallerie d'Arques J. G. Durand & CIE., Arques, France

[21] Appl. No.: 24,984

[22] Filed: Mar. 12, 1987

[30] Foreign Application Priority Data

Mar. 21, 1986 [FR] France ..... 86 04044

[51] Int. Cl.[4] ..... B65D 71/00

[52] U.S. Cl. ..... 206/426; 206/45.14; 229/112; 229/115

[58] Field of Search ..... 206/45.14, 45.19, 45.31, 206/45.34, 426, 427, 429, 434, 435; 229/111, 112, 115, 164, 162

[56] References Cited

U.S. PATENT DOCUMENTS

| | | | |
|---|---|---|---|
| 3,157,275 | 11/1964 | Tolaas | 206/45.14 |
| 3,437,193 | 4/1969 | Freeman | 206/45.14 |
| 3,884,353 | 5/1975 | Forte | 206/426 |
| 3,994,397 | 11/1976 | Fishlove | 206/434 |
| 4,164,286 | 8/1979 | Sutherland | 206/434 |
| 4,199,059 | 4/1980 | Maroszek | 206/45.19 |
| 4,201,294 | 5/1980 | Roccaforte | 206/45.31 |
| 4,385,687 | 5/1983 | Dutcher | 206/45.19 |

FOREIGN PATENT DOCUMENTS

| | | | |
|---|---|---|---|
| 1145091 | 3/1963 | Fed. Rep. of Germany | 206/426 |
| 89608 | 6/1967 | France . | |
| 830200 | 3/1960 | United Kingdom . | |

*Primary Examiner*—Jimmy G. Foster

*Attorney, Agent, or Firm*—Gottlieb, Rackman & Reisman

[57] ABSTRACT

This one-piece packaging is made from a blank of foldable material and includes a top wall whose width is less than the width of the bottom wall, and is not greater than half the maximum transverse dimension of the articles. This width may, in the limit, be zero. As a result: at least a portion of the height of the front wall is sloping; the windows cut out in the front wall which have bottom portions that are narrower than the maximum transverse dimension of the bottom regions of the articles in order to retain the articles in the packaging also have top portions whose width is equal to the maximum transverse dimension of the top regions of the articles so that said top regions of the articles project as much as possible from said packaging; and the side end faces of the packaging which are optionally closed by walls are at least partially trapezoidal, and in said limit are at least partially triangular when said top wall is of zero width.

20 Claims, 2 Drawing Sheets

DISPLAY PACKAGING FOR A PLURALITY OF ALIGNED DRINKING GLASSES OR SIMILAR ARTICLES

The present invention relates to display packaging for a plurality of aligned drinking glasses or similar articles (e.g. vases, bottles, etc.), said packaging being made as a single piece from a sheet of foldable material which is cut and folded in appropriate manner.

The number of aligned articles may lie in the range 2 to 12 (which range should not be taken as limiting), depending on the size of the articles (e.g. orangeade tumbler or liqueur glass) and the use for which it is intended (e.g. drinking glasses or flower vases).

The foldable material may be a sheet of card, of plastified card, or of semi-rigid plastic material, and it should be capable of receiving various types of printing such as offset or flexographic printing, etc., for commercial purposes.

BACKGROUND OF THE INVENTION

Display packaging for aligned articles such as drinking glasses is already known. Such packaging may comprise: a rear wall having the same height as the article; a front wall of the same height, disposed parallel to the rear wall and having windows cut therein for each article, with the width of each window being less than the maximum transverse dimension of the bottom region of the corresponding article in order to hold it in the packaging; a top wall interconnecting the front wall and the back wall; and a double bottom wall constituted by folded extensions from the front wall and the rear wall lying one over the other, said extensions being held assembled together by locking tabs cut out from one of them and received in facing openings made in the other; the top wall and the bottom wall being of identical width which is less than the maximum transverse dimension of the articles but greater than half of said dimension so that the articles project only slightly through the corresponding windows in order to be partially visible; said top and bottom walls optionally including front edges that project beyond the windows of the front wall so that the tops and the bottoms of the articles are fully covered.

The present invention seeks to provide display packaging of this type, but which is improved in a manner such that the articles are shown off better.

SUMMARY OF THE INVENTION

To this end, the present invention provides display packaging for a plurality of aligned drinking glasses or similar articles, said packaging being made in one piece from a blank of foldable material which is cut out and provided with fold lines, said fold lines delimiting in said blank:

two rectangular panels intended to become the rear wall and the front wall of the packaging, said rear wall having the same height as the articles;

a rectangular link strip between said panels intended to form the top wall of the packaging; and two rectangular strips extending said panels beyond the sides thereof which are furthest from said link strip, said two rectangular strips being intended, when the packaging is assembled by folding along the fold lines, to be superposed and held assembled together in order to constitute the bottom wall of the packaging, with the width of said bottom wall being not greater than the maximum transverse dimension of the bases of the articles;

said bottom wall and said top wall being intended to be disposed substantially perpendicularly to said rear wall when the packaging is assembled, and the panel constituting the front wall of the packaging having as many windows cut out therein as there are articles to be packed, said windows extending up to said connection strip constituting the top wall;

the display packaging including the improvement whereby the width of the top wall is less than the width of the bottom wall and is not greater than one-half of the maximum transverse dimension of the articles, and may be zero in the limit, and as a result:

the panel forming the front wall slopes over at least a portion of its height relative to a direction perpendicular to the bottom and top walls and has an overall height greater than that of the articles so as to enable the bottom wall to remain substantially perpendicular to the rear wall;

the windows cut out in the front wall whose bottom portions are narrower than the maximum transverse dimension of the bottom regions of the articles in order to hold the articles in the packaging have top portions of the same width as the maximum transverse dimension of the top regions of the articles to enable said regions to project as much as possible from the packaging; and the end side faces of the assembled packaging are at least partly trapezoidal and, in the limit when said top wall is of zero width, they are at least partially triangular.

With this packaging structure, while the articles remain securely held, they are also very largely disengaged from the front face of the packaging, thereby enabling a potential purchaser to touch and feel the articles to see their outlines clearly, and to see the shape and the thickness of the drinking edges of drinking glasses. The articles are thus much more attractive, thereby making them sell better. In the prior art display packaging the articles were enclosed to a much greater extent so their shape was less clearly visible and it was much more difficult to judge the thickness of their walls.

Article visibility may be further increased by cutouts in the rear wall of the packaging.

An intermediate fold line parallel to the bottom and top walls may be provided on the front wall of the packaging, said intermediate fold line dividing the front wall into top and bottom portions having different slopes.

Preferably, the bottom wall is provided with a forwardly-projecting sill beneath each window to ensure that the bases of the articles are completely covered by the packaging, and the two superposed rectangular strips constituting the bottom wall are held together by locking tabs cut out from one of them and engaged in corresponding openings provided in the other, with said locking means being provided in between the articles and thus level with portions of the front wall which are situated between the windows therein.

The display packaging may include two side end walls constituted by flaps which longitudinally extend the sides of the front wall or the rear wall beyond fold lines, with each of said flaps including at least one locking tab for insertion, after the flap has been folded along the fold line, into the packaging against at least one of the rear or front walls. Such side walls reinforce and protect the longitudinal ends of the packaging and ensure that it occupies a determined volume when fully assembled.

The display packaging may also be provided with tabs which extend both ends of the bottom and top walls and which are foldable perpendicularly to said walls into the inside of the packaging in order to consolidate the top and bottom ends of the side end walls and to maintain the spacing between the front and rear walls.

This one-piece packaging can be completely assembled and locked by hand around the articles without requiring any glue. The packaging may alternatively be assembled mechanically either with or without glue. If glue is used, then at least some of the locking tabs may be omitted. No further protection is required in outer packaging (e.g. boxes) for shipping and storing display packages filled with articles. In particular, there is no need to add protection plates.

BRIEF DESCRIPTION OF THE DRAWINGS

A particular embodiment of display packaging in accordance with the invention is described below by way of example and with reference to the accompanying drawings, in which.

MORE DETAILED DESCRIPTION

Figure 1:
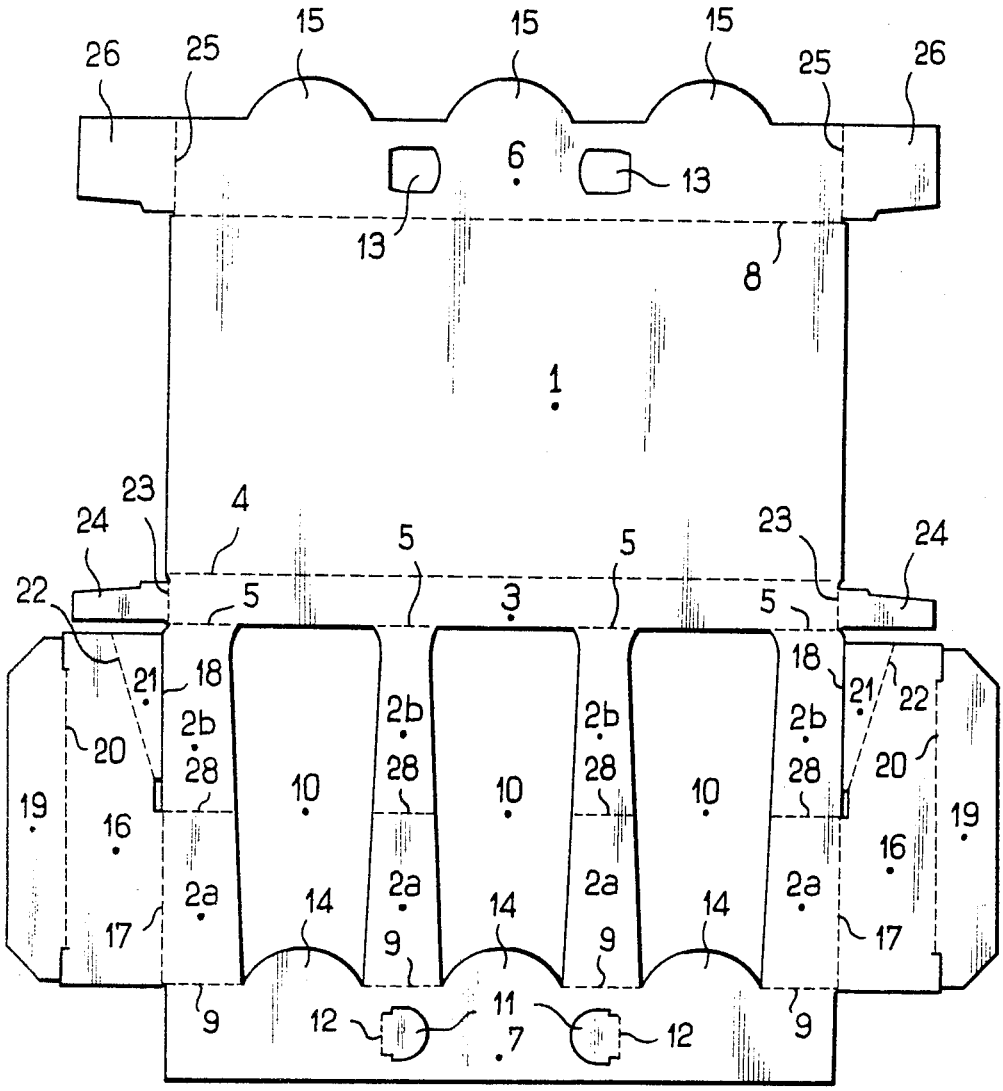
FIG. 1 is a plan view of a blank of foldable material, e.g. card, from which the display packaging may be formed.

On the suitably cut out one-piece card blank shown in FIG. 1, the fold lines are represented by dashed lines.

Cutting out is performed using a cutter and the fold lines are scored by means of a scoring knife.

The card blank comprises: a rectangular panel 1 which is to serve as the back wall of the packaging and whose width (which is to become the height of said wall) is equal to the height of the articles to be packed; a rectangular panel 2*a*–2*b* to become the front wall of the packaging and whose width is slightly greater than the width of the panel 1; a rectangular strip 3 interconnecting the panels 1 and 2*a*–2*b*, and delimited by fold lines 4 and 5, said strip being intended to form the top wall of the packaging; and two rectangular strips 6 and 7 respectively extending the panels 1 and 2*a*–2*b* beyond respective fold lines 8 and 9 in order to constitute the bottom wall of the packaging.

As many windows 10 are cut out from the panel 2*a*–2*b* as there are articles to be packed. In this particular case, these windows are slightly flared towards the rectangular strip 3 which is to constitute the top wall of the packaging. The rectangular strips 6 and 7 which are to form the bottom wall of the packaging are considerably wider than the top wall rectangular strip 3. Locking tabs 11 are cut out in the strip 7 to fold about fold lines 12, and co-operating openings 13 are cut out in the rectangular strip 6. The locking tabs 11 of the bottom wall are located level with portions of the panel 2*a*–2*b* that are situated between the windows 10. The rectangular strip 7 has extensions 14 in the form of circular segments projecting into the bottoms of the windows 10, and the rectangular strip 6 has corresponding extensions 15 of the same shape. The rectangular strips 6 and 7 are of the same width and they are intended, when the packaging is assembled, to be exactly superposed over each other so as to constitute a double thickness bottom wall for the packaging, with the strip 7 being placed beneath the strip 6 so that it is possible to thrust the locking tabs 12 into the openings 13. An intermediate fold line 28 is provided on the rectangular panel 2*a*–2*b*, with said fold line separating the panel into bottom and top regions respectively referenced 2*a* and 2*b*.

The rectangular panel 2*a*–2*b* is extended in its longitudinal direction by two flaps 16, each of which projects beyond a fold line 17 and a line of cut 18. Each flap 16 is provided with a main locking tab 19 beyond a fold line 20 and with an auxiliary locking tab 21 beyond a fold line 22. The two flaps 16 serve to form two end side walls for the assembled packaging. The narrow linking rectangular strip 3 which constitutes the top wall of the assembled packaging is extended at each of its ends beyond fold lines 23 by two tabs 24 for consolidating said end side walls, and the rectangular strip 6 which contributes to constituting the bottom wall is also extended, beyond fold lines 25 at each of its ends, by tabs 26, likewise for consolidating said end side walls.

The bottom portions of the windows 10 adjacent to the rectangular strip 7 are narrower than the maximum transverse dimension of the bottom regions of the articles 27 (in this case drinking glasses) which are shown in FIGS. 2 to 5, and the width of the top portions of the windows 10 adjacent to the linking rectangular strip 3 is equal to the maximum transverse dimension of the tops of the articles. The rectangular strips 6 and 7 which form the bottom wall are narrower than the maximum transverse dimension of the bases of the glasses 27 except for their extensions 14 and 15 which widen said strips so that they are exactly equal to said dimension. The width of the rectangular link strip 3 which constitutes the top wall is less than half the maximum transverse dimension of the glasses 27.

Figure 2:
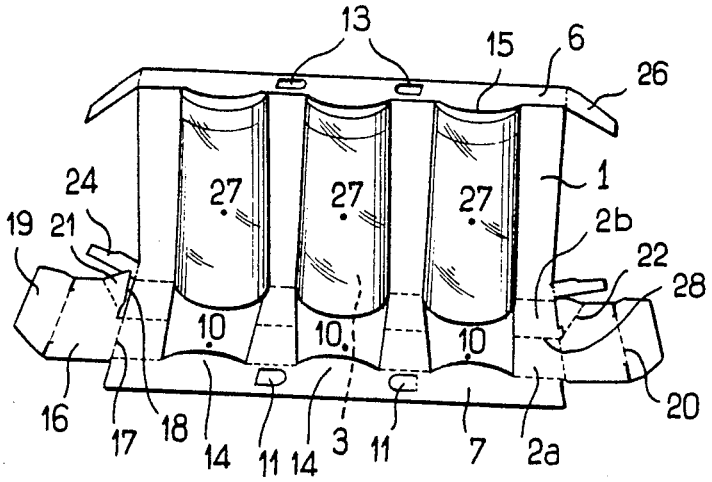
FIGS. 2, 3, and 4 are perspective views on a smaller scale showing the packaging being assembled around the articles to be packaged, with FIG. 4 showing the completed display packaging together with the articles it contains.
Figure 3:
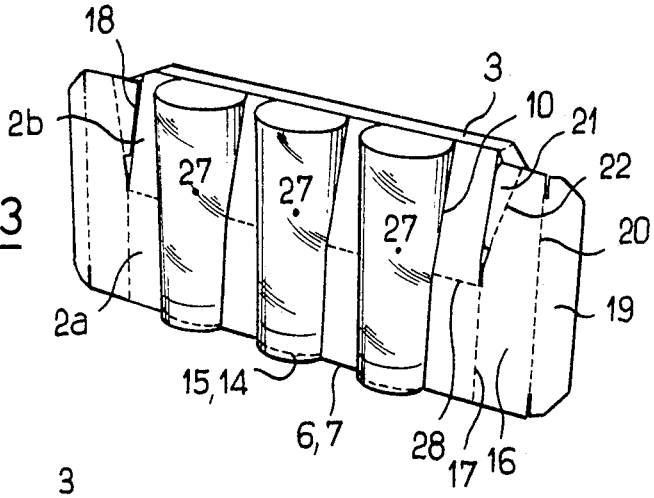
Figure 4:
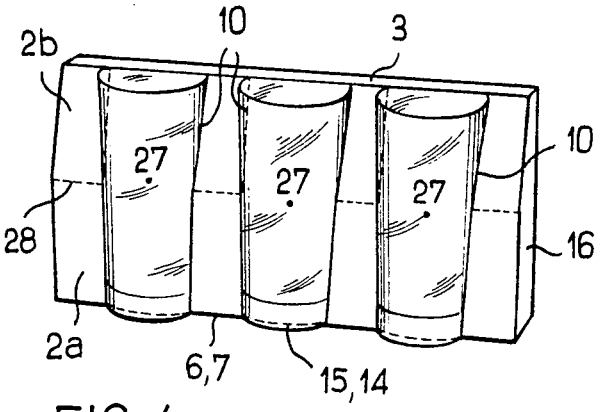

The packaging is assembled and the glasses 27 are simultaneously packed as shown in FIGS. 2 to 4.

The card blank as shown in FIG. 1 is initially scored along the fold lines. The glasses 27 are then placed upside-down on said blank with their drinking edges standing on the rectangular link strip 3 and extending partially over the tops of the windows 10. Then the panel 1 is lifted from behind to come vertically against the glasses and the rectangular strip 6 is folded perpendicularly forwardly over the bottoms of the glasses (see FIG. 2). Thereafter, the front panel 2*a*–2*b* is folded up from the front against the glasses and the rectangular strip 7 is folded backwardly to press against the rectangular strip 6, and the locking tabs 11 are thrust into the openings 13. The top wall 3, the back wall 1, the bottom wall 6, 7 and the front wall 2*a*–2*b* of the packaging are thus established and the glasses are enclosed thereby with their bottoms being completely covered by said extensions 14 and 15.

The display packaging is then turned over (see FIG. 3). It can be seen that in the particular example chosen, the bottom portion 2*a* of the front wall is perpendicular to the bottom wall while its top region 2*b* slopes backwardly towards the rear wall 1. In this top region the glasses 27 are almost totally disengaged from the packaging while being retained therein by the bottom region of the front wall by virtue of the difference in width of the windows 10 in said top and bottom regions 2*a* and 2*b*. The front wall could slope uniformly from its base to its top, or alternatively the bottom region 2*a* could slope while the top region 2*b* could be perpendicular to the top and bottom walls. In addition, the top wall 3 could be reduced to zero thickness, in which case the top portions of the glasses 27 would be completely disengaged from the packaging.

The extensions 14 and 15 of the rectangular strips 6 and 7 forming the double thickness bottom wall have circular edges because the glasses 27 are circular in section. If the glasses were polygonal in section, then the edges of the extensions 14 and 15 would likewise be polygonal in shape.

In FIG. 4, the packaging is shown completed. Its side end walls have been formed by folding the consolidating side tabs 24 and 26 respectively downwardly and upwardly to maintain the separation between the front and back walls, by engaging the auxiliary locking tabs 21 behind the top region 2*b* of the front wall while simultaneously folding the flaps 16 over the sides towards the back wall 1; and finally the main locking tabs 19 are inserted into the packaging against the inside face of the rear wall 1.

It would also be possible to fully assemble the packaging without turning it over halfway through assembly.

Figure 5:
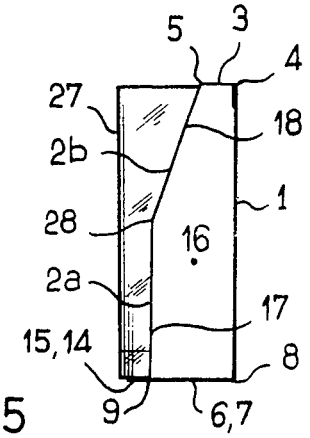
FIG. 5 is a side view of said display packaging.

FIG. 5 shows the shape of the side end wall of the packaging as closed by the flap 16 and thus shows the vertical cross-section of the packaging. This cross-section is in the form of a rectangle having a trapezium on top. It could be simply a large trapezium if the width of the top wall was reduced to zero, or if the front face sloped uniformly. If both options are applied simultaneously, then the cross-section becomes a large triangle.

Other detail modifications and technical equivalents may be applied to the above-described display packaging without going beyond the scope of the invention.

I claim:

1. Display packaging for a plurality of aligned drinking glasses or similar articles, said display packaging being made in one piece from a blank of foldable paperboard or like sheet material which is cut out and provided with fold lines;

said display packaging comprising:

a rear wall and a front wall constituted by two rectangular panels of said blank, said rear wall having the same height as the articles;

a top wall interconnecting said rear and front walls and constituted by a rectangular link strip of said blank located between said panels and connected thereto by respective fold lines;

a bottom wall constituted by two rectangular end strips of said blank connected by fold lines with said panels at parts of the latter which are furthest from said link strip, said end strips being superposed one to the other and held assembled together;

said bottom wall and said top wall being disposed substantially perpendicularly to said rear wall;

said front wall having as many windows cut out therein as there are articles to be packed, with said windows extending up to said top wall;

said windows having bottom portions which are narrower than the maximum transverse dimension of the bottom regions of the articles to enable said front wall to hold the articles in the packaging, and having top portions of the same width as the maximum transverse dimension of the top regions of the articles to enable said top regions to project as much as possible from the packaging forwardly of said front wall;

the width of said bottom wall being at most equal to the maximum transverse dimension of the bases of the articles, and the width of said top wall being less than the width of said bottom wall and not greater than one-half of the maximum transverse dimension of the articles, whereby said front wall slopes over at least a portion of its height relative to a direction perpendicular to said bottom and top walls and has an overall height greater than that of the articles; and two side end walls of at least partly trapezoidal outline and constituted by two flaps of said blank each connected by a respective fold line to one or the other of the opposite lateral ends of said panels constituting said front and rear walls, each of said flaps including at least one locking tab adapted, upon being folded along a fold line in that flap, for insertion into the interior of the packaging against at least one of said rear and front walls.

2. Display packaging according to claim 1, including cutouts in the rear wall for increasing the visibility of the articles.

3. Display packaging according to claim 1, wherein an intermediate fold line is provided on said front wall of the packaging between the fold lines adjoining said front wall with said top and bottom walls and divides said front wall into a top portion and a bottom portion.

4. Display packaging according to claim 3, wherein said bottom wall has a respective projecting edge beneath each window in said front wall so that the bases of the articles are completely covered by the packaging.

5. Display packaging according to claim 3, wherein said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough.

6. Display packaging according to claim 3, wherein said bottom wall has a projecting edge beneath each window in said front wall so that the bases of the articles are completely covered by the packaging, and said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough.

7. Display packaging according to claim 1, wherein said bottom wall has a respective projecting edge beneath each window in said front wall so that the bases of the articles are completely covered by the packaging.

8. Display packaging according to claim 7, wherein said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough.

9. Display packaging according to claim 1, wherein said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough.

10. Display packaging according to claim 1, wherein each of said flaps includes a main locking tab and an auxiliary locking tab.

11. Display packaging according to claim 10, wherein one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

12. Display packaging according to claim 1, wherein one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

13. Display packaging according to claim 1, wherein an intermediate fold line is provided on said front wall of the packaging between the fold lines adjoining said front wall with said top and bottom walls and divides said front wall into a top portion and a bottom portion, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

14. Display packaging according to claim 1, wherein said bottom wall has a projecting edge beneath each window in said front wall so that the bases of the articles are completely covered by the packaging, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

15. Display packaging according to claim 1, wherein said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

16. Display packaging according to claim 1, wherein an intermediate fold line is provided on said front wall of the packaging between the fold lines adjoining said front wall with said top and bottom walls and divides said front wall into a top portion and a bottom portion, said bottom wall has a projecting edge beneath each window in said front wall so that the bases of the articles are completely covered by the packaging, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

17. Display packaging according to claim 1, wherein an intermediate fold line is provided on said front wall of the packaging between the fold lines adjoining said front wall with said top and bottom walls and divides said front wall into a top portion and a bottom portion, said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

18. Display packaging according to claim 1, wherein an intermediate fold line is provided on said front wall of the packaging between the fold lines adjoining said front wall with said top and bottom walls and divides said front wall into a top portion and a bottom portion, asid bottom wall has a projecting edge beneath each window in said front wall so that the bases of the articles are completely covered by the packaging, said two superposed rectangular end strips constituting said bottom wall are held together by locking means constituted by cooperating locking tabs cut out in one of said end strips and corresponding openings cut out in the other, with said tabs being thrust into said openings, respectively, said locking means being provided at locations intermediate the locations of the articles in the packaging and thus in line with portions of said front wall situated between the windows therethrough, and one of said end strips constituting said bottom wall and said link strip constituting said top wall are extended by respective tabs capable of being folded perpendicularly to said bottom and top walls towards the inside of the packaging in order to consolidate said side end walls with said top and bottom walls and to maintain the separation between said rear and front walls.

19. Display packaging according to claim 18, including cutouts in the rear wall for increasing the visibility of the articles.

20. Display packaging according to claim 19, wherein each of said flaps includes a main locking tab and an auxiliary locking tab.

* * * * *